United States Patent [19]

Focke

[11] Patent Number: 4,928,817

[45] Date of Patent: May 29, 1990

[54] PACKAGING FOR A PLURALITY OF SMALL PACKS, ESPECIALLY CIGARETTE PACKS

[75] Inventor: Heinz Focke, Verden, Fed. Rep. of Germany

[73] Assignee: Focke & Co. (GmbH & Co.), Verden, Fed. Rep. of Germany

[21] Appl. No.: 347,850

[22] Filed: May 5, 1989

[30] Foreign Application Priority Data

May 30, 1988 [DE] Fed. Rep. of Germany ..... 3818285

[51] Int. Cl.[5] ..... B65D 5/48

[52] U.S. Cl. ..... 206/256; 206/242; 206/264

[58] Field of Search ..... 206/264, 242, 273, 256, 206/271

[56] References Cited

U.S. PATENT DOCUMENTS

| | | | |
|---|---|---|---|
| 2,605,897 | 8/1952 | Rundle | 206/264 |
| 3,051,305 | 8/1962 | Houle | 206/264 |
| 3,063,553 | 11/1962 | Nicholson | 206/273 X |
| 3,071,244 | 1/1963 | Doran | 206/273 X |
| 3,148,768 | 9/1964 | Gatto | 206/264 X |
| 3,596,758 | 8/1971 | Phillips, Jr. | 206/256 |
| 3,809,227 | 5/1974 | Begemann | 206/264 |
| 4,738,354 | 4/1988 | Phillips, Jr. | 206/273 |
| 4,773,531 | 9/1988 | Tudor et al. | 206/256 |

FOREIGN PATENT DOCUMENTS

| | | |
|---|---|---|
| 7720150 | 11/1977 | Fed. Rep. of Germany . |
| 3313462 | 10/1984 | Fed. Rep. of Germany . |
| 3705156 | 8/1987 | Fed. Rep. of Germany . |

*Primary Examiner*—William Price

*Attorney, Agent, or Firm*—Sughrue, Mion, Zinn, Macpeak & Seas

[57] ABSTRACT

Packaging for a plurality of small packs, especially cigarette packs. Several cigarette packs (21) are combined to form small groups or bundles, so-called sticks (20). Each group of cigarette packs (21) is held together by means of a wrapping (22) consisting of paper, cardboard of film material. So that at least the bottom walls (27) of the cigarette packs (21) are exposed or are accessible, the wrapping (22) is open on at least one side (longitudinal side 28). The cigarette packs (21) are connected to one another and to the wrapping (22) by means of an adhesively bonded film strip (30) or by means of individual strips (36, 37). Markings can be made on the film strip (29). The packaging (stick 20) is simple to produce mechanically and is easy to handle.

7 Claims, 7 Drawing Sheets

PACKAGING FOR A PLURALITY OF SMALL PACKS, ESPECIALLY CIGARETTE PACKS

BACKGROUND OF THE INVENTION

The invention relates to a packaging with a wrapping consisting of paper, cardboard or plastic film for a plurality of small packs, especially small bundles (sticks) of cigarette packs, the end wall and bottom wall of each of which confront a respective (narrow) sideface of the wrapping.

The packagings dealt with here are, above all, small bundles of cigarette packs, that is to say so-called cigarette sticks. Up to twenty or twenty-five cigarette packs are combined by means of a wrapping in order to form a stick. The wrapping can consist of paper, (thin) cardboard or a film material.

Because of statutory regulations, in some countries it is necessary to equip each cigarette pack with a (revenue) mark immediately before sale to the final consumer. The mark, usually a marking made by stamping, a number, a state coat of arms or the like, is to be affixed to part of the cigarette pack, particularly to the outer wrapping of the latter. This regulation presents difficulties when cigarette packs are delivered as sticks.

SUMMARY OF THE INVENTION

The object on which the invention is based to design a packaging, especially a small bundle of cigarette packs, in such a way that any markings, marks, etc. which are necessary can be affixed to the individual cigarette packs, without changing the packaging, especially without opening it.

To achieve this object, the packaging described in the introduction is characterized in that the cigarette packs (or other small packs) are connected (solely) by means of adhesive film to one another in the region of their end wall and/or their bottom wall and to the wrapping open in this region.

In the invention, the packaging is designed so that the wrapping receiving the cigarette packs remains partially open, especially in the region of the bottom walls of the cigarette packs. The markings prescribed by statutory regulation as the case may be are to be affixed to the cigarette packs here. In order nevertheless to make the packaging a permanently coherent unit, (strip-shaped) films are attached in the region of the open sides of the wrapping and are bonded to the exposed faces (bottom walls) of the cigarette packs on the one hand and of the wrapping on the other hand. At the same time, the markings are made on the film connected to each cigarette pack by adhesive bonding. When the packaging is to be brought to practical use, the film is severed in the region between the individual cigarette packs, especially by means of an appropriately arranged perforation or other material weakening functioning as a predetermined parting line. Individual portions of the film equipped with a marking thus remain permanently on each cigarette pack. A packaging (stick) designed in this way can be equipped with the necessary marking, for example by a wholesaler or by a retailer, without particular manipulations on the packaging being necessary.

Furthermore, the advantage of the design according to the invention of the packaging is that it is simple to produce and material for the wrapping is saved. Moreover, the open sides of the wrapping reveal the packaging content, especially when a transparent film is used as a closure for the open sides.

The invention can be used in an especially advantageous way on divisible packagings, that is to say on those cigarette sticks which can be divided into several, especially two part sticks. In this design according to the invention, the packaging consists of (two) part wrappings which are connected releaseably to one another, in such a way that open sides, especially open longitudinal sides, lie next to one another. These are then closed either by means of a common film strip of appropriate dimensions or by means of individual strips assigned to each part stick. The necessary markings are made jointly or simultaneously on the cigarette packs of the complete packaging. The packaging can then be divided into part sticks and delivered.

Further details of the invention relate to the design of the wrapping and the arrangement and design of the film for closing this. Exemplary embodiments of the invention are explained in detail below by means of the drawings. In these:

DETAILED DESCRIPTION OF PREFERRED EMBODIMENTS

Figure 1:
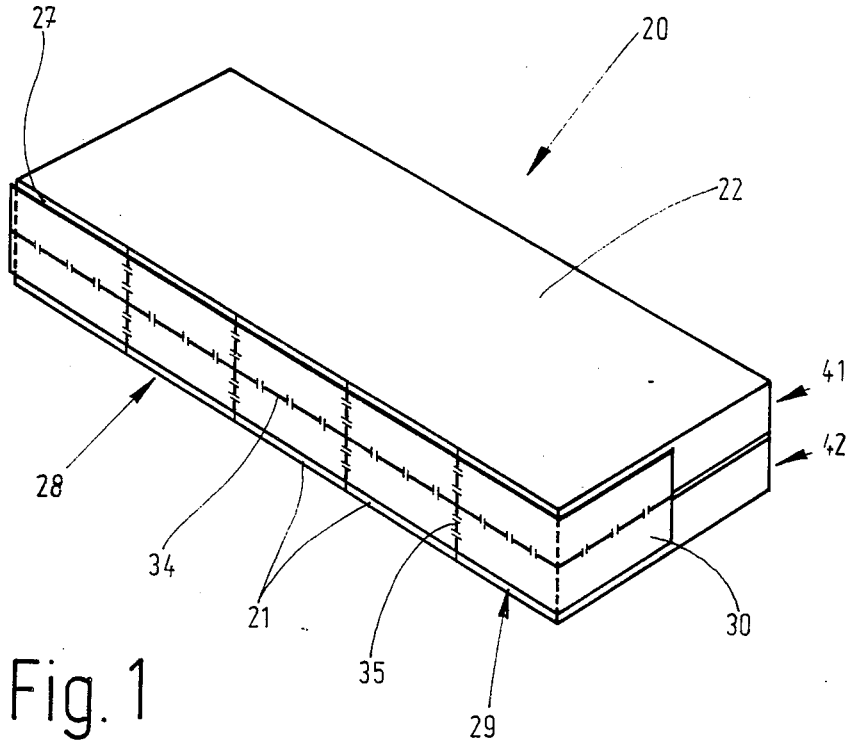
FIG. 1 shows a packaging, particularly a stick of cigarette packs, in a perspective representation.
Figure 4:
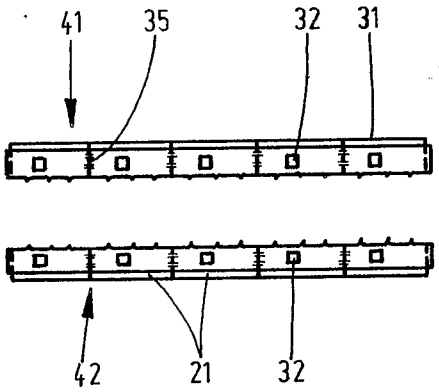
FIG. 4 shows the packaging according to FIG. 2 and FIG. 3 after division into part sticks.
Figure 3:
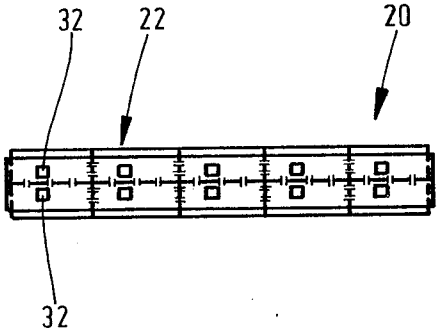
FIG. 3 shows the packaging according to FIG. 2 after markings have been made.
Figure 2:
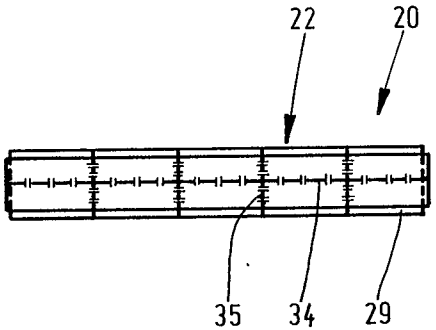
FIG. 2 shows a side view of the packaging according to FIG. 1 on a reduced scale.

The exemplary embodiments of the packaging which are shown in the drawings relate to so-called sticks 20 for receiving a plurality of small packs, in the present case cigarette packs 21. Each particular group of cigarette packs 21 lying next to one another is surrounded by a wrapping 22 made of paper, cardboard or film material.

In the exemplary embodiments illustrated, each stick 20 consists of ten cigarette packs 21. These are arranged next to and above one another in two pack rows 23, 24, in such a way that narrow side faces 25 of adjacent cigarette packs 21 rest against one another. The cigarette packs 21 are oriented with their longitudinal axis transverse relative to the longitudinal extension of the stick 20. End walls 26 and bottom walls 27 are thus exposed, without contact with adjacent cigarette packs 21.

The wrapping 22 is arranged in such a way that one side of this, particularly a longitudinal side 28, is open. In the region of this open longitudinal side 28 of the wrapping 22, the bottom walls 27 of the cigarette packs 21 lie next to one another. These are therefore exposed within the wrapping 22.

In order nevertheless to close the stick 20 in a sufficiently durable manner, a closing strip consisting particularly of an adhesive, especially self-adhesive film is attached to the region of the open longitudinal side 28. This film is guided in the form of a film strip 29 over the open longitudinal side 28 of the wrapping 22, thereby bonding adhesively (over the entire surface) to the bottom walls 27 of the cigarette packs 21. These are thus connected to one another and also to the wrapping 22.

The dimensions of the film strip 29 in the longitudinal direction are such that film ends 30 are connected to the outer face of the wrapping 22, specifically to transversely directed narrow sides 31 of the latter. The film strip 29 is thereby connected permanently to the wrapping 22.

In the present exemplary embodiments, the width of the film strip 29 is smaller than the width or height of the stick 20 and also smaller than the width or height of the cigarette packs 21 arranged next to or above one another.

Markings 32 can be made on the outer face of the film strip 29 in the region of each cigarette pack 21, especially by means of a movable stamping member, past which the stick 20 together with the film strip 29 is moved.

To put the stick 20 to practical use, the film strip 29 can be divided into individual film pieces 33 which are assigned to each cigarette pack 21 and which adhere to the bottom wall 27. For this purpose, the film strip 29 is equipped with weakening lines in the region between the cigarette packs 21. In the exemplary embodiment of FIGS. 1 to 4, the common film strip 29 is equipped with a longitudinal perforation 34 and transverse perforations 35. The abovementioned perforations 34 and 35 extend respectively in the region of abutting surfaces between adjacent cigarette packs 21.

In the exemplary embodiment according to FIGS. 6 to 12, the open longitudinal side 28 of the wrapping 22 is closed by means of two individual strips 36, 37 of (self-)adhesive film. Here, the individual strips 36, 37 have a smaller width than the height or width of the cigarette packs 21. Individual strips 36, 37 extend at a distance from one another so that they can be attached centrally in relation to the bottom walls 27. Strip ends 38, 39 are connected to the narrow sides 31 of the stick 20. In the parting plane between respective adjacent cigarette packs 21, a transverse perforation 40 is made in the individual strips 36, 37, in order to form film pieces 33 on each bottom wall 27 of the cigarette packs 21.

Figure 5:
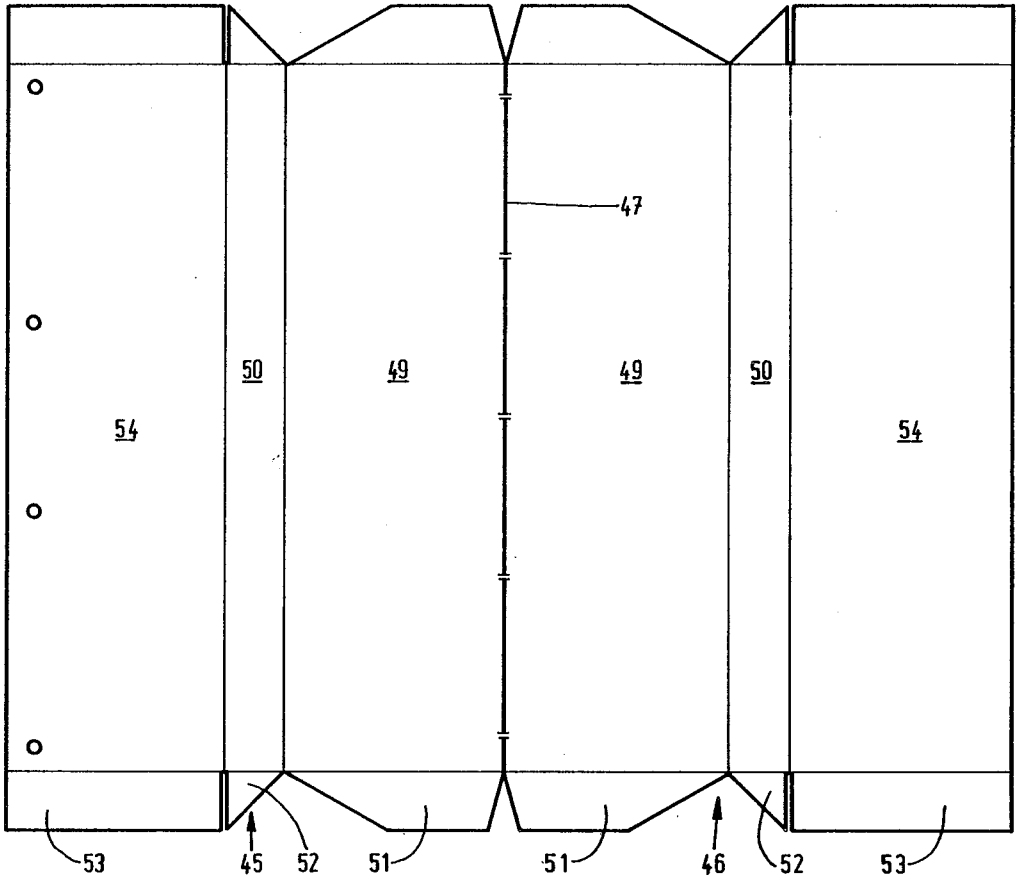
FIG. 5 shows a blank for producing a wrapping in the spread-out position.

The exemplary embodiments illustrated incorporate a further special feature in that they are designed as a "double stick". Each stick 20 consists, here, of two part sticks 41, 42. These are themselves equipped with a separate part wrapping 43, 44 with respective open longitudinal sides 2B. The part sticks 41, 42 are connected releaseably to one another. For this purpose, here the part sticks 41, 42 are formed from a common blank (FIG. 5), the part blanks 45, 46 of which are connected to one another separately via a perforation folding line 47. Furthermore, glue spots 48 are applied here in the region of mutually confronting inner covering walls 49 of the part wrappings 43, 44. In the complete "double stick", the abovementioned covering walls 49 rest against one another and are (additionally) connected releaseably to one another by means of the glue spots 48.

The part blanks 45, 46 connected to one another via the perforation folding line 47 to form a unit have surface regions for forming longitudinal side walls 50 and narrow sides 31. The latter are formed by folding tabs partially overlapping one another, particularly by internal trapezoidal inner tabs 51 in the region of the inner covering walls 49, triangular inner tabs 52 in the region of the narrow longitudinal side walls 50 and rectangular outer tabs 53 in the region of outer covering walls 54. The design of the trapezoidal inner tabs 52 ensures that, in the folding position (FIG. 7), these do not overlap one another, but lie next to one another in one plane. The inner tabs 51 and 52 are covered by the outer tab 53 forming the full narrow side 31. This outer tab 53 is connected to the inner tabs 51 and 52 by adhesive bonding.

Figure 7:
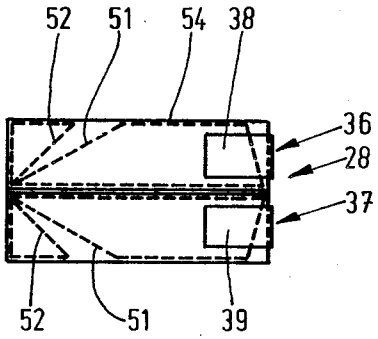
FIG. 7 shows an end view of the packaging according to FIG. 6.
Figure 9:
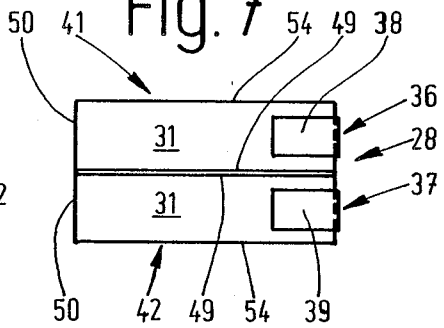
FIG. 9 shows a simplified version in a representation corresponding to that of FIG. 7.
Figure 6:
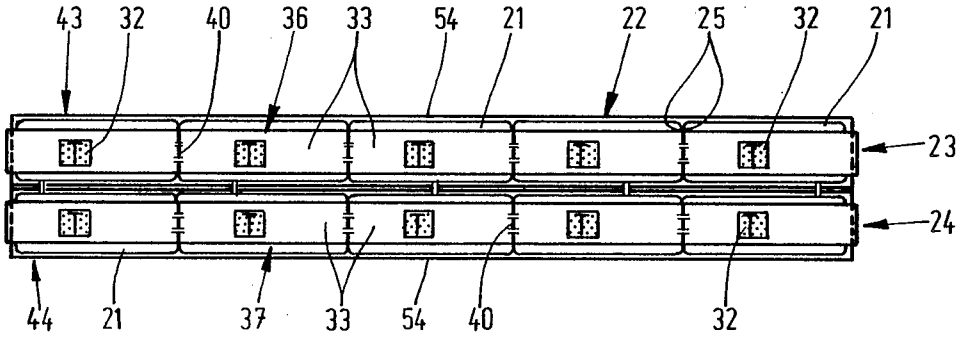
FIG. 6 shows a side view of another exemplary embodiment of a packaging on an enlarged scale.
Figure 8:
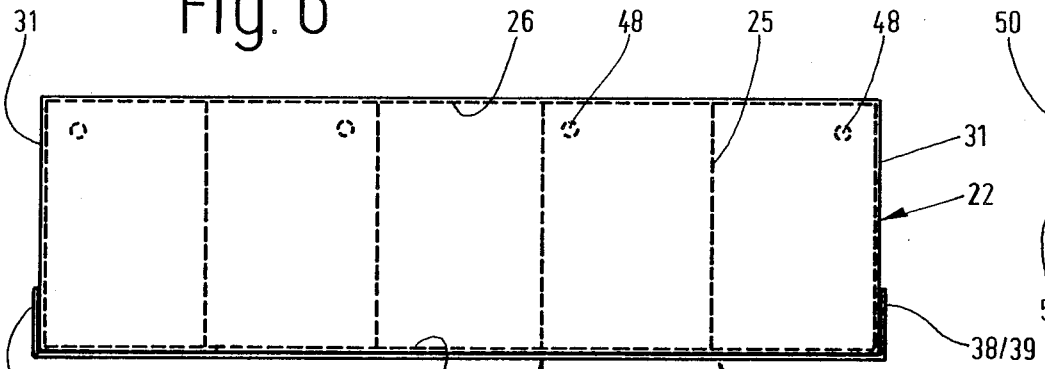
FIG. 8 shows a plan view of the packaging according to FIG. 6.
Figure 10:
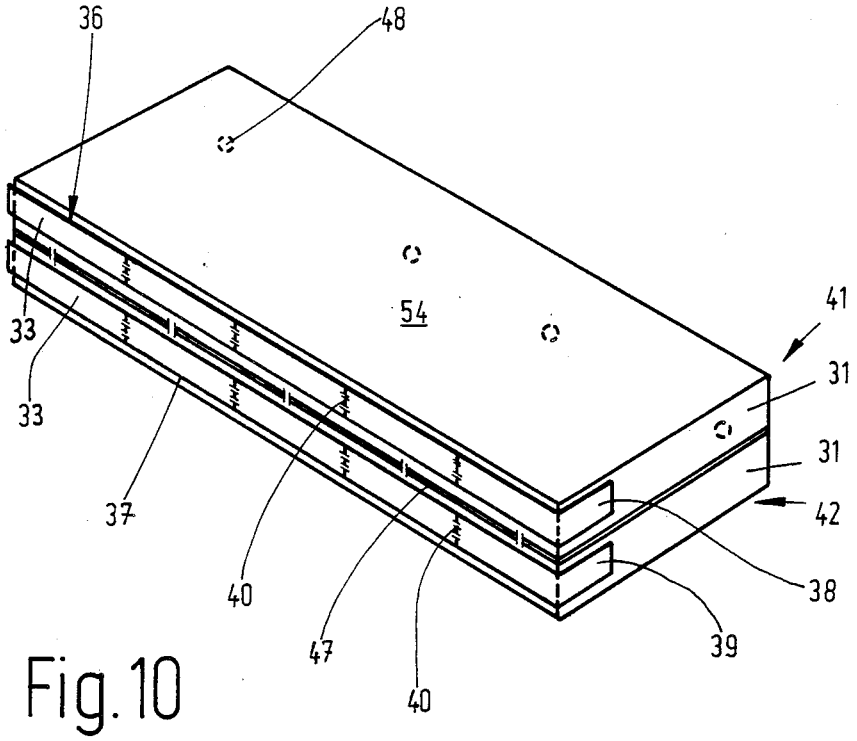
FIG. 10 shows the packaging according to FIGS. 6 to 9 in a perspective representation.
Figure 11:
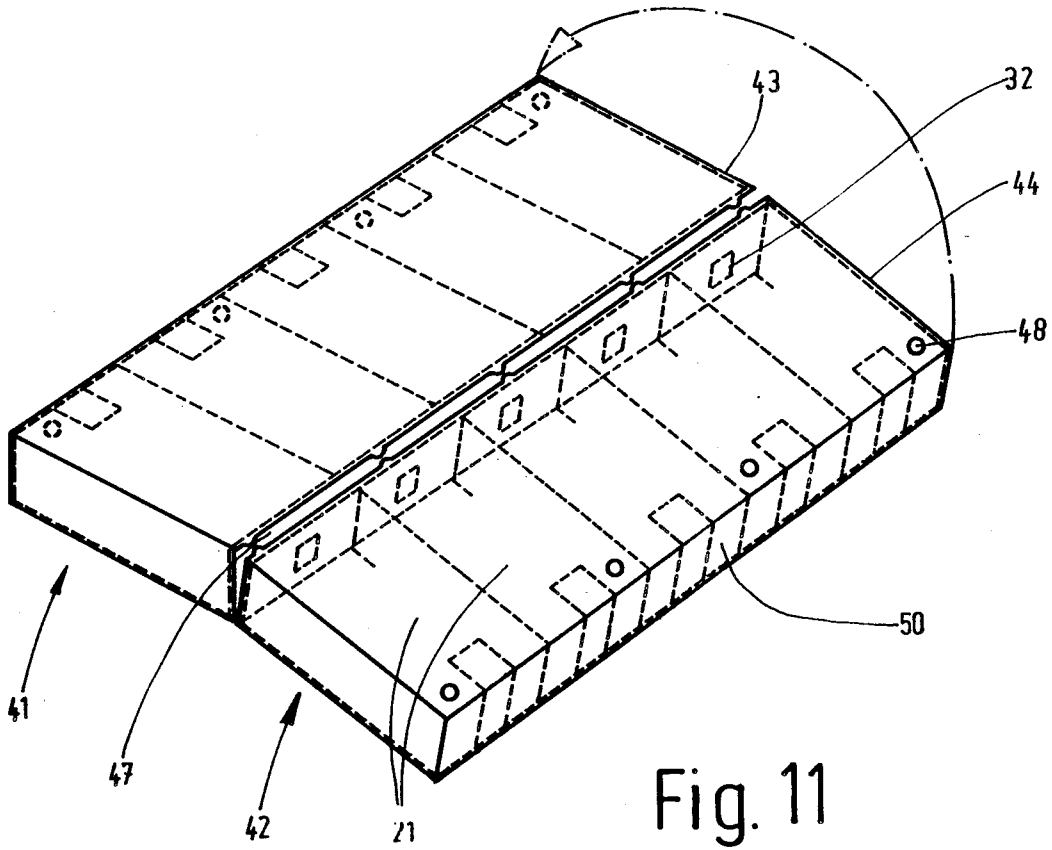
FIG. 11 shows the packaging according to FIG. 10 during a phase in the division into part sticks.
Figure 12:
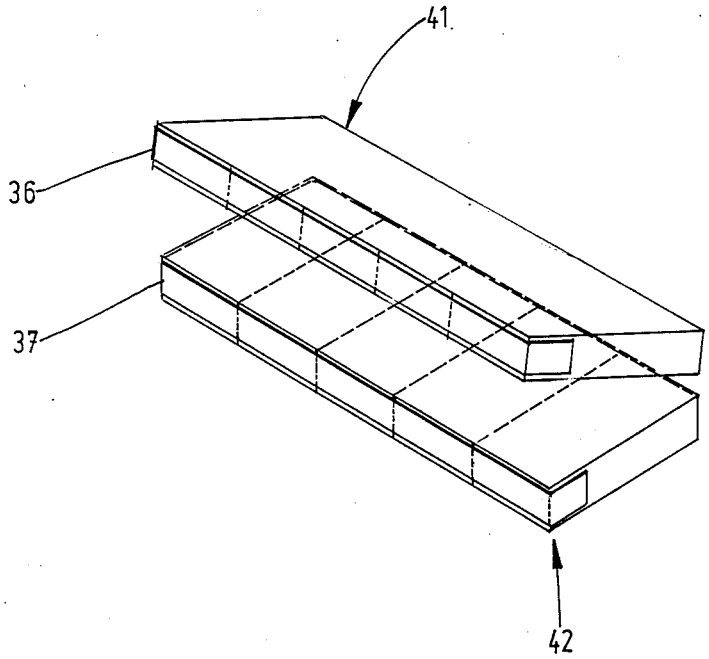
FIG. 12 shows two part sticks in a perspective representation.

The "double stick" thus constructed can be delivered to the consumer as a single unit. However, it can also be divided into the two part sticks 41, 42, as shown in FIG. 7 or in FIGS. 11 and 12. For this, the two part sticks 41, 42 are first lifted off from one another on the same side as the film strip 49 or of the individual strips 36, 37, an adhesive bond, present if appropriate, thereby being broken. The perforation line 47 can then be severed by breaking the part sticks 41, 42 about an edge located opposite the perforation line 47 (FIG. 11). Each part stick 41, 42 is now an independently saleable unit.

What is claimed is:

1. Packaging for a plurality of cigarette packs (20) and including a wrapping (22) in which the cigarette packs are wrapped to form an elongated stick of cigarette packs, opposite end walls (26, 27) of the packs facing respective opposite side faces (28, 50) of the wrapping.

wherein said wrapping (22) is open at least in the region of one of its side faces (28, 50) so that the pack end walls (27) facing this open side face (28) are not covered by said wrapping (22) in which the cigarette packs (21) are wrapped;

wherein said pack end walls (27) not covered by said wrapping (22) are connected to one another and to said wrapping (22) solely by adhesive strip means (36, 37) which is glued across the open side face (28) of said wrapping (22) on the uncovered pack end walls (27) of the wrapped packs (21), and which has opposite ends (30) glued on respective opposite narrow sides (31) of said wrapping (22); and wherein the uncovered end wall (27) of each cigarette pack (21) is assigned a different section (33) of a plurality of sections of said adhesive strip (29; 36, 37), said sections being adapted to receive markings and being defined by weakened dividing lines.

2. Packaging according to claim 1, wherein said adhesive strip means (29; 36, 37) is glued on said wrapping (22) only at said opposite narrow sides (31) thereof.

3. Packaging according to claim 1 or 2, comprising two elongated part sticks (41, 42) of cigarettes, each part stick (41, 42) having a part wrapping (43, 44) open at a longitudinal side (28); each part stick (41, 42) having a plurality of cigarette packs (21) arranged in a pack row (23, 24) with an end wall (27) of each of said cigarette packs (21) facing the open longitudinal side (28), said cigarette packs (21) being connected to one another in the region of their uncovered end walls (27) by said adhesive strip means.

4. Packaging according to claim 3, wherein said adhesive strip means (29) comprises two individual strips (36, 37) extending at a distance from each other; and wherein the cigarette packs (21) of each part stick (41, 42) are connected by a different one of said individual strips (36, 37) to one another and to said wrapping (22), each of said individual strips (36, 37) being of a width slightly smaller than the width of one of the assigned end walls (27).

5. Packaging according to claim 3, wherein said adhesive strip means comprises film strip means (29) having a width approximately equal to the combined width of two cigarette packs (21) disposed next to one another, and also having a longitudinal perforation (34) along which said two part sticks (41, 42) are divisible in a longitudinal mid-plane.

6. Packaging according to claim 5, wherein the part wrappings (43, 44) of the part sticks (41, 42) each consist of a separate blank and are releaseably connected to one another by glue spots (48) in the region of covering walls (49) resting against one another.

7. Packaging according to claim 5, wherein the part wrappings (43, 44) of the part sticks (41, 42) are part blanks (45, 46) of a one-piece blank, said part blanks being releaseably connected to one another, along a perforation folding line (47) extending between the part wrappings (43, 44), to form said open longitudinal side (28).

* * * * *